US011020683B2

(12) United States Patent
Fang et al.

(10) Patent No.: US 11,020,683 B2
(45) Date of Patent: Jun. 1, 2021

(54) BUILDING BLOCK AND BUILDING BLOCK KIT

(71) Applicant: UBTECH ROBOTICS CORP LTD, Shenzhen (CN)

(72) Inventors: Xiongyuan Fang, Shenzhen (CN); Youjun Xiong, Shenzhen (CN); Tao Bai, Shenzhen (CN)

(73) Assignee: UBTECH ROBOTICS CORP LTD, Shenzhen (CN)

( * ) Notice: Subject to any disclaimer, the term of this patent is extended or adjusted under 35 U.S.C. 154(b) by 0 days.

(21) Appl. No.: 16/727,949

(22) Filed: Dec. 27, 2019

(65) Prior Publication Data

US 2021/0086096 A1 Mar. 25, 2021

(30) Foreign Application Priority Data

Sep. 23, 2019 (CN) ..... 201910899948.8

(51) Int. Cl.
*A63H 33/08* (2006.01)
*A63H 33/06* (2006.01)

(52) U.S. Cl.
CPC ..... *A63H 33/062* (2013.01); *A63H 33/086* (2013.01)

(58) Field of Classification Search
CPC ..... A63H 33/06–088
USPC ..... 439/592–596; 446/120–128
See application file for complete search history.

(56) References Cited

U.S. PATENT DOCUMENTS 2,487,654 A * 11/1949 Hoffman ..... A63H 33/102 446/122
2,699,128 A * 1/1955 Johnson ..... A63H 33/062 52/90.1
2,765,581 A * 10/1956 Adler ..... A63H 33/101 446/121
2,786,301 A * 3/1957 Torricelli ..... A63H 33/084 446/115
2,907,137 A * 10/1959 Ehrmann ..... A63H 33/082 446/127
3,148,477 A * 9/1964 Bjphirn ..... A63H 33/082 52/591.2
3,195,266 A * 7/1965 Onanian ..... A63H 33/101 446/86

(Continued)

FOREIGN PATENT DOCUMENTS

CN 203916092 U 11/2014

*Primary Examiner* — Eugene L Kim
*Assistant Examiner* — Matthew B Stanczak

(57) ABSTRACT

A building block includes at least one of a plug portion and a socket portion. The plug portion has two cantilevered tongues deflectable toward each other. Each cantilevered tongue includes a first engaging portion. The socket portion defines a chamber and has two second engaging portions. The plug portion and the socket portion are configured in such a way that the plug portion of one building block is insertable into the chamber of the socket portion of another building block, and the two cantilevered tongues of the building block deflect toward each other after insertion of the plug portion of the building block into the chamber of the socket portion of the other building block, which allows the first engaging portions of the building block to be engaged with the second engaging portions of the other building block, thereby connecting the two building blocks together.

8 Claims, 8 Drawing Sheets

(56) References Cited

U.S. PATENT DOCUMENTS 3,768,846 A * 10/1973 Hensley ..... F16B 5/0607 52/127.5
4,159,592 A * 7/1979 Gabriel ..... A63H 33/101 24/287
4,345,762 A * 8/1982 Lebelson ..... A63F 3/00697 273/157 R
5,106,093 A * 4/1992 Engel ..... A63H 33/08 273/160
5,222,902 A * 6/1993 Piersch ..... A63H 33/062 403/345
5,350,331 A * 9/1994 Glickman ..... A63H 33/042 446/120
5,482,491 A * 1/1996 Kichijyo ..... A63H 33/08 446/112
5,599,221 A * 2/1997 Gabriel ..... A63H 33/10 446/124
5,826,394 A * 10/1998 Barton, Jr. ..... A63H 33/044 52/592.1
5,871,384 A * 2/1999 Kichijo ..... A63H 33/062 446/112
5,928,051 A * 7/1999 Krog ..... A63H 33/10 446/104
6,250,986 B1 * 6/2001 Sorensen ..... A63H 33/062 446/121
6,292,979 B1 * 9/2001 Kuo ..... A45C 13/262 16/113.1
6,450,853 B1 * 9/2002 Larws ..... A63H 33/101 446/122
6,739,935 B2 * 5/2004 Van Teunenbroek ..... A63H 37/00 273/451
7,481,692 B2 * 1/2009 Bruder ..... A63H 33/101 446/122
7,648,407 B1 * 1/2010 Sorensen ..... A63H 33/084 446/120
8,074,418 B2 * 12/2011 Thiagarajan ..... E04D 3/366 52/590.1
8,282,427 B2 * 10/2012 Yamazaki ..... H01R 13/4368 439/752
8,651,914 B2 * 2/2014 Sisamos ..... A63H 33/101 446/120
9,377,042 B2 * 6/2016 De Wilde ..... A63H 33/062
9,724,617 B2 * 8/2017 Lin ..... A63H 33/101
9,889,388 B2 * 2/2018 Liu ..... A63H 33/084
9,917,398 B1 * 3/2018 Ryland ..... A63H 33/088
10,029,187 B2 * 7/2018 Liu ..... A63H 33/08
2002/0031944 A1 * 3/2002 Endo ..... H01R 13/641 439/595
2002/0115374 A1 * 8/2002 Lavender ..... A63H 33/04 446/85
2003/0027456 A1 * 2/2003 Yamawaki ..... H01R 13/639 439/595
2003/0082986 A1 * 5/2003 Wiens ..... A63H 33/062 446/120
2005/0272301 A1 * 12/2005 Bruder ..... A63H 33/107 439/409
2006/0286864 A1 * 12/2006 Bethurum ..... H01R 24/28 439/595
2008/0064261 A1 * 3/2008 Kobayashi ..... H01R 13/506 439/594
2013/0165012 A1 * 6/2013 Klauber ..... A63H 33/042 446/91
2016/0121235 A1 * 5/2016 Lin ..... A63H 33/101 446/124
2017/0274294 A1 * 9/2017 Liu ..... A63H 13/00
2019/0321741 A1 * 10/2019 Park ..... A61H 1/0292
2020/0191187 A1 * 6/2020 Heo ..... A63H 33/062

* cited by examiner

BUILDING BLOCK AND BUILDING BLOCK KIT

CROSS REFERENCE TO RELATED APPLICATIONS

This application claims priority to Chinese Patent Application No. 201910899948.8, filed Sep. 23, 2019, which are hereby incorporated by reference herein as if set forth in its entirety.

BACKGROUND

1. Technical Field

The present disclosure generally relates to building blocks, and particularly to a building block kit including building blocks that are connected to one another by snap fit connection.

2. Description of Related Art

A wide variety of block toys presently exist, including those permitting connection of individual blocks by mutually snapping concave portions and convex portions formed in and on the individual blocks and those making use of a magnet arranged on a block and a magnetic member arranged on another block so that these blocks can be connected together by magnetic force. Although these block engagement means can work well for connecting the blocks together, it is still desirable and useful to provide a building block kit including building blocks that are connected to one another by a new connection mechanism.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
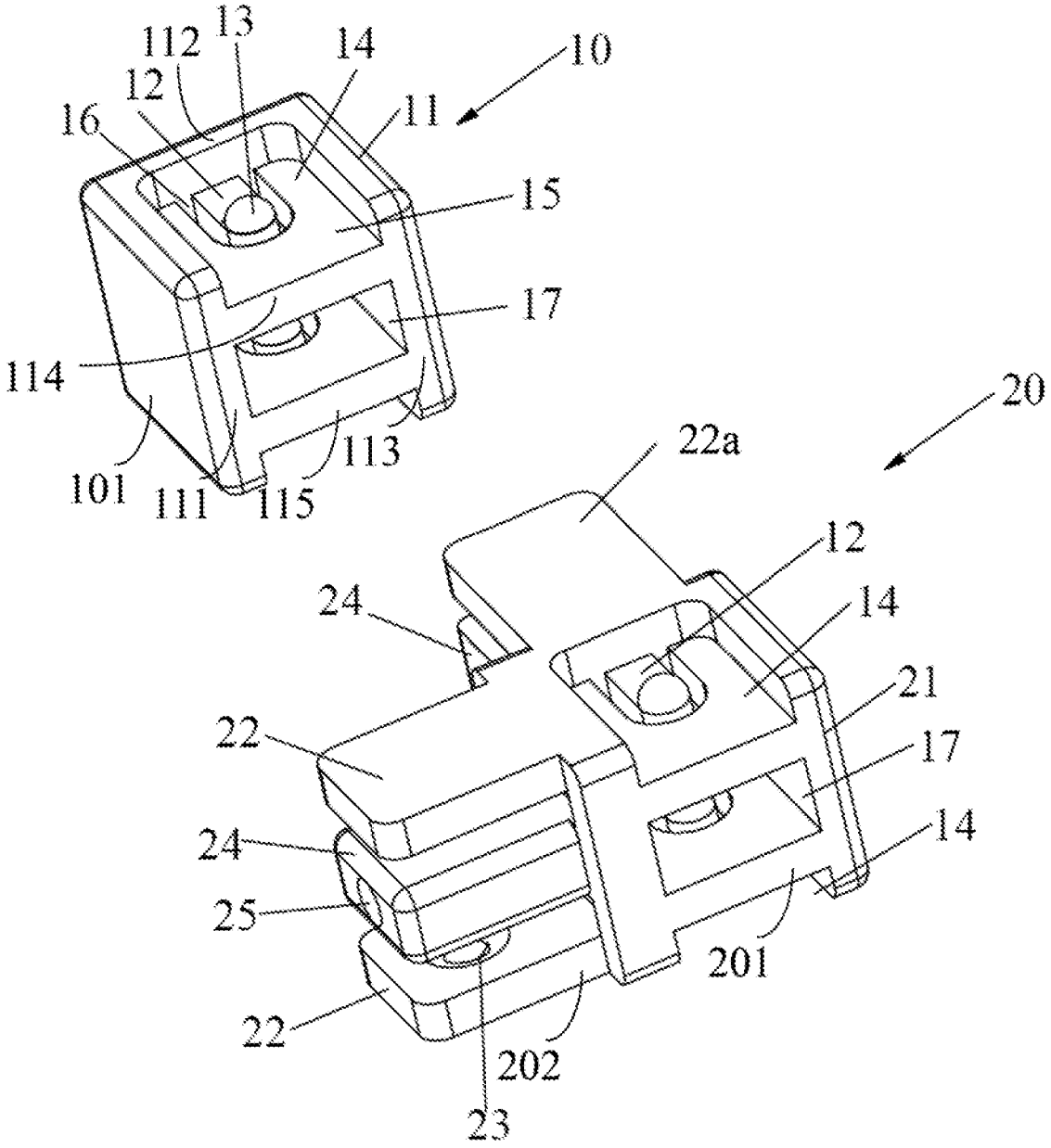
FIG. 1 is an isometric view of two building blocks according to an embodiment.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

The terms "upper", "lower", "left" and "right", indicating the orientational or positional relationship based on the orientational or positional relationship shown in the drawings, are merely for convenience of description, but are not intended to indicate or imply that the device or elements must have a particular orientation or be constructed and operated in a particular orientation, and therefore should not be construed as limiting the present invention. The terms "first" and "second" are used for descriptive purposes only and are not to be construed as indicating or implying relative importance or implicitly indicating the number of technical features. The meaning of "multiple" is two or more, unless expressly stated otherwise.

The present disclosure provides a building block including at least one of a plug portion and a socket portion. For example, in one embodiment as shown in FIGS. 1-4, a building block 10 includes only a plug portion, and a building block 20 includes both a plug portion and a socket portion. A person having ordinary skill in the art will realize that a building block according to the present disclosure may include only a socket portion according to need. The building block 10 may also be referred to as a male building block. The building block having a socket portion may also be referred to as a female building block.

Figure 3:
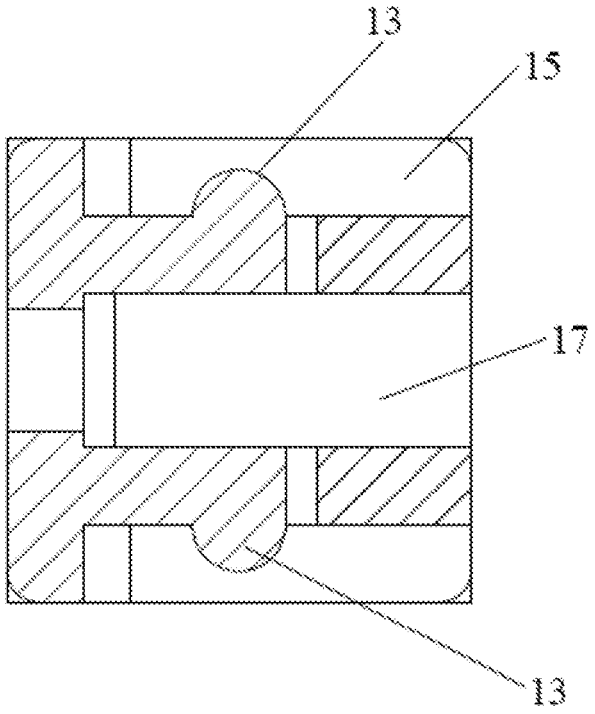
FIG. 3 is a cross-sectional view of the building blocks of FIG. 2.
Figure 5:
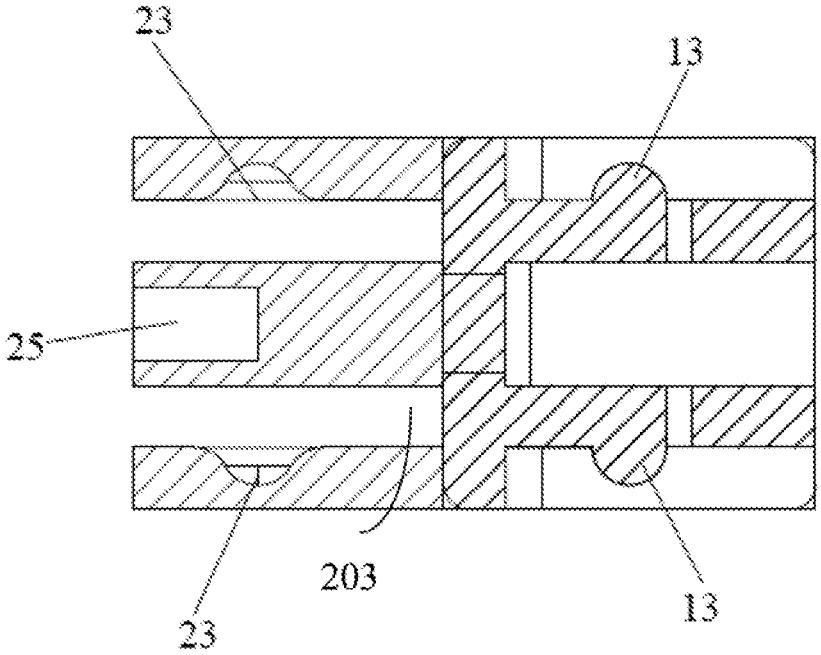
FIG. 5 is a cross-sectional view of the building blocks of FIG. 4.

In one embodiment, the building block 10 includes a plug portion 101 that includes a cuboid main body 11 and two cantilevered tongues 12 that are spaced apart from and deflectable toward each other. Each of the two cantilevered tongues 12 includes a first engaging portion 13 at an end thereof. The second building block 20 includes a plug portion 201 and a socket portion 202, each of which includes a main body. In the embodiment, the plug portion 201 and the socket portion 202 share a same main body 21. The plug portion 201 and the plug portion 101 have the same configuration. The socket portion 202 further includes two outer plates 22 protruding from an outer surface of the main body 21. The two outer plates 22 define corporately a chamber 203 (see FIG. 5) therebetween. The socket portion 202 further includes two second engaging portions 23 that are respectively arranged on the two outer plates 22. In the embodiment, as shown in FIG. 3, one first engaging portion 13 protrude from an upper surface of one cantilevered tongue 12, and the other first engaging portion 13 protrude from a lower surface of the other cantilevered tongue 12. In the embodiment, each of the second engaging portions 23 define a recess (see FIG. 5). In an alternative embodiment, the recesses may be formed in the first engaging portions 13 and the second engaging portions 23 may be protrusion protrude from the outer plates 22.

Figure 8:
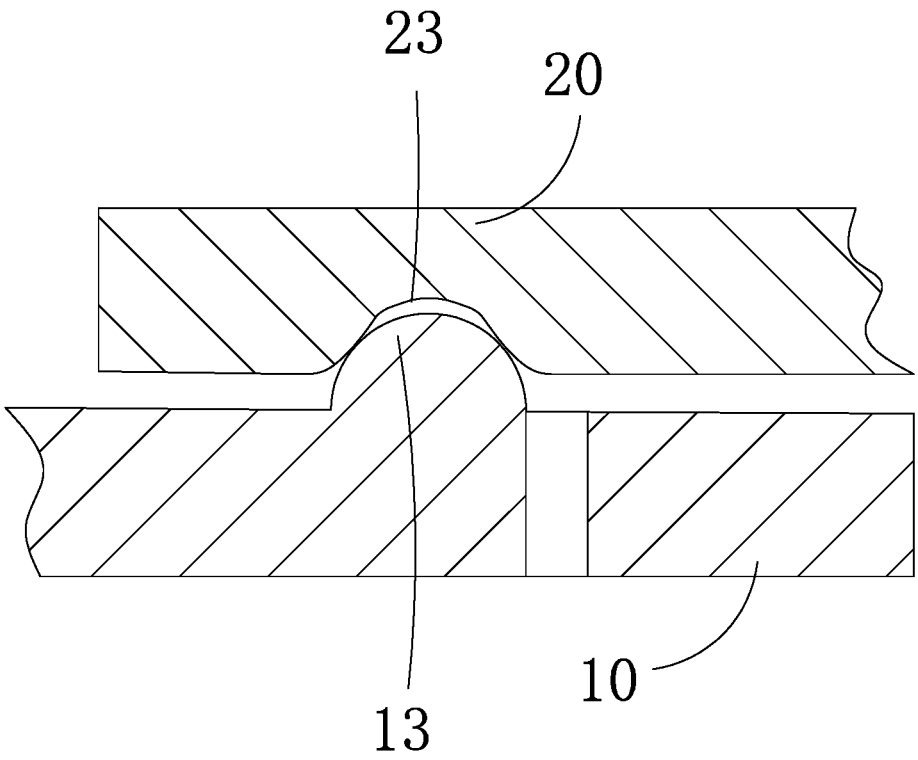
FIG. 8 is a partial cross-sectional view of a first engaging portion engaged with a second engaging portion of two building blocks.

The plug portion 101 and the socket portion 202 are configured in such a way that the plug portion 101 of the building block 10 is insertable into the chamber 203 of the socket portion 202 of the building block 20, and the two cantilevered tongues 12 of the building block 10 deflect toward each other after insertion of the plug portion 101 into the chamber 203 of the socket portion 202, which allows the first engaging portions 13 of the building block 10 to be engaged with the second engaging portions 23 of the building block 20 (see FIG. 8), thereby detachably connecting the two building blocks 10 and 20 together. In the embodiment, the engagement of the first engaging portions 13 with the second engaging portions 23 means that the first engaging portions 13 are respectively received in the recesses of the second engaging portions 23.

It should be noted that since the plug portion 201 and the plug portion 101 have the same configuration, two building blocks 20 can be detachably connected to each other by engagement between the plug portion 201 of one building block 20 with the socket portion 202 of the other building block 20. The engagement between the plug portion 201 with the socket portion 202 are achieved the same way as the engagement between the plug portion 101 with the socket portion 202 described above.

With such configuration, two building blocks of the present disclosure can be firmly connected to each other, and will not be disengaged from each other without an external force from a user. In addition, the deflection of the cantilevered tongues is used to realize the engagement between the first and second engaging portions, which has low requirements on molds, reduces production cost, and greatly improves the competitiveness. Furthermore, the size and the number of the first engaging portions 13 and the recesses of the second engaging portions 23 can vary so as to provide different level of firmness of connection between two building blocks.

In one embodiment, the main body 11 includes three side walls 111, 112 and 113 that are connected to one another, and two inner plates 114 and 115 arranged within a space defined by the three side walls 111, 112 and 113 and connected to the three side walls 111, 112 and 113. The two cantilevered tongues 12 protrude from the side wall 112 that are connected to both of the two side walls 111 and 113. Each of the two inner plates 114 and 115 defines a through hole 16, and the two cantilevered tongues 12 are respectively received in the through holes 16 of the two inner plates 114 and 115.

The three side walls 111, 112 and 113 and the two inner plates 114 and 115 corporately define two receiving spaces 14 with an opening 15. The two outer plates 22 of the building block 20 can be respectively inserted, through the openings 15, into the two receiving spaces 14 of the building block 10 or another building block 20. The two engaging portions 13 protruding from the two cantilevered tongues 12 are respectively located in the two receiving spaces 14. During insertion of the outer plates 22, they will first come into contact with the two engaging portions 13. Since each engaging portion 13 has a curved surface, the outer plates 22 can continue moving after they come into contact with the curved surfaces. The cantilevered tongues 12 are then be pressed to deflect toward each other. After the outer plates 22 move to their desired positions, the engaging portions 13 are received in the recesses of the second engaging portions 23, thereby connecting the building block 20 to the building block 10 or another building block 20.

In one embodiment, a guiding structure is provided to guide the building block 10 to move with respect to the building block 20. Specifically, the two inner plates 114 and 115 corporately define a hollow space 17 therebetween, and the socket portion 202 include a block 24 arranged between the two outer plates 22. The block 24 is sized and shaped according to the hollow space 17. The block 24 of the building block 20 can be fit in the hollow space 17 of the building block 10 or another building block 20. With such arrangement, the block 24 of the building block 20 guides the building block 10 or another building block 20 when a user attempts to connect them together.

In one embodiment, the through holes 16 respectively communicate with the receiving spaces 14 and the hollow space 17. During insertion of the outer plates 22 into the receiving spaces 14, the outer plates 22 move in the receiving space 14 and the block 24 moves in the hollow space 17. During their movement, the outer plates 22 will press the cantilevered tongues 12 to deflect and come into contact with the block 24. Each cantilevered tongue 12 is then sandwiched between the block 24 and one outer plate 22.

In one embodiment, the hollow space 17 has a rectangular, circular or trapezoidal cross section, and a cross section of the block 24 is shaped and sized according to the cross section of the hollow space 17.

Figure 2:
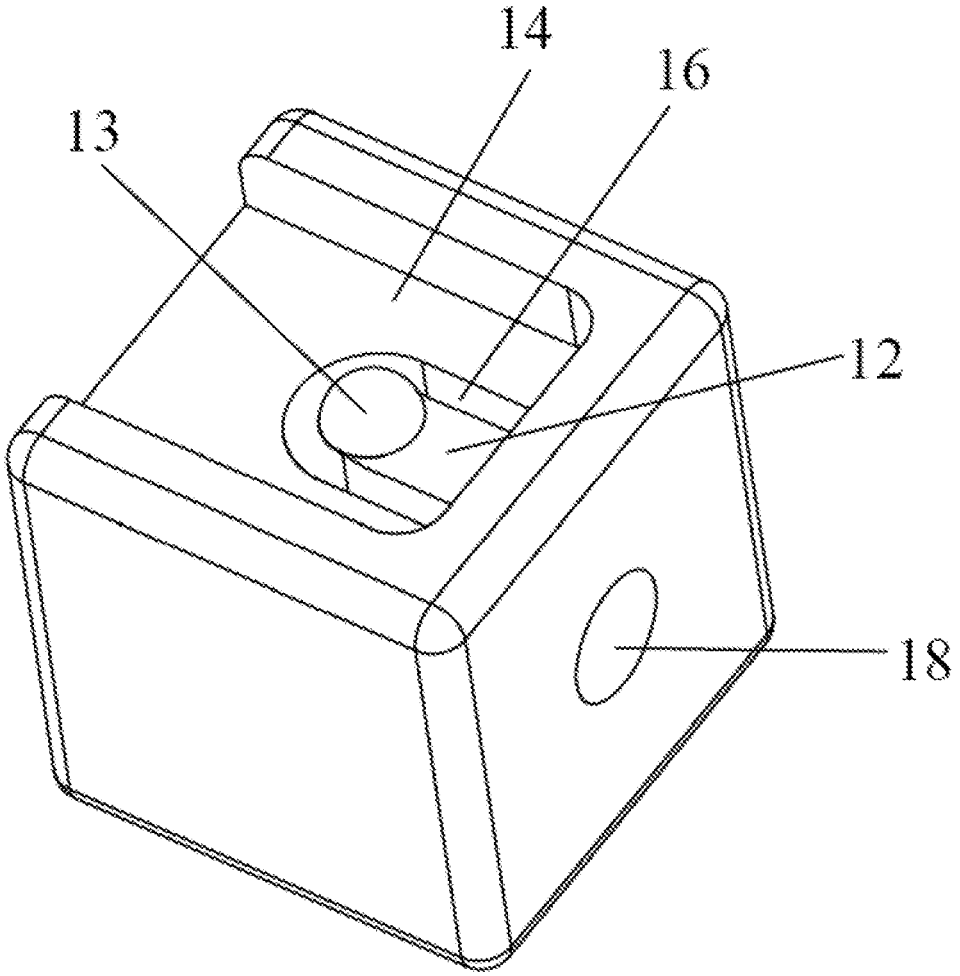
FIG. 2 is an isometric view of one of the building blocks of FIG. 1.
Figure 4:
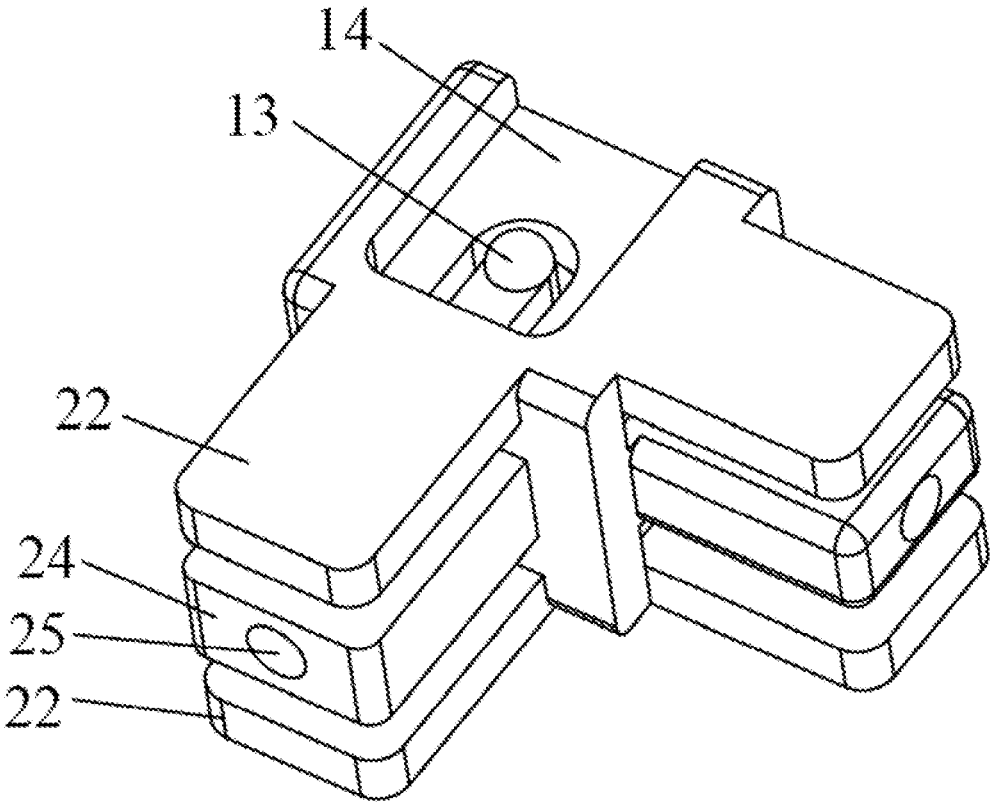
FIG. 4 is an isometric view of the other building block of FIG. 1.

Referring to FIGS. 2 and 4, in one embodiment, the side wall 112 from which the cantilevered tongues 12 protrude defines a first orifice 18 extending therethrough, and the block 24 defines a second orifice 25 corresponding to the first orifice 18. With such arrangement, a pin can be inserted through the first orifice 18 and into the second orifice 25, and an external decoration member or an external extension member can be connected to the building blocks through the pin.

In one embodiment, the structure of the main body 21 of the building block 20 is the same as that of the building block 10. It should be noted that the structure of the main body 21 may be different from that of building block 10.

In one embodiment, the socket portion 202 further includes two additional outer plates **22*a* protruding from the main body 21. The two additional outer plates 22*a* are shaped and sized in the same way the two outer plates 22, and extend in a direction perpendicular to an extending direction of the two outer plates 22, or in a direction opposite the extending direction of the two outer plates 22. That is, as shown in FIG. 1, the two additional outer plates 22*a* may protrude from a surface of the main body 21 adjacent to or opposite the surface where the outer plates 22 protrude. It should be noted that the socket portion 202 may further include two pairs of outer plates 22*a* protruding from two surfaces of the main body 21 adjacent to and opposite the surface where the outer plates 22** protrude.

Figure 6:
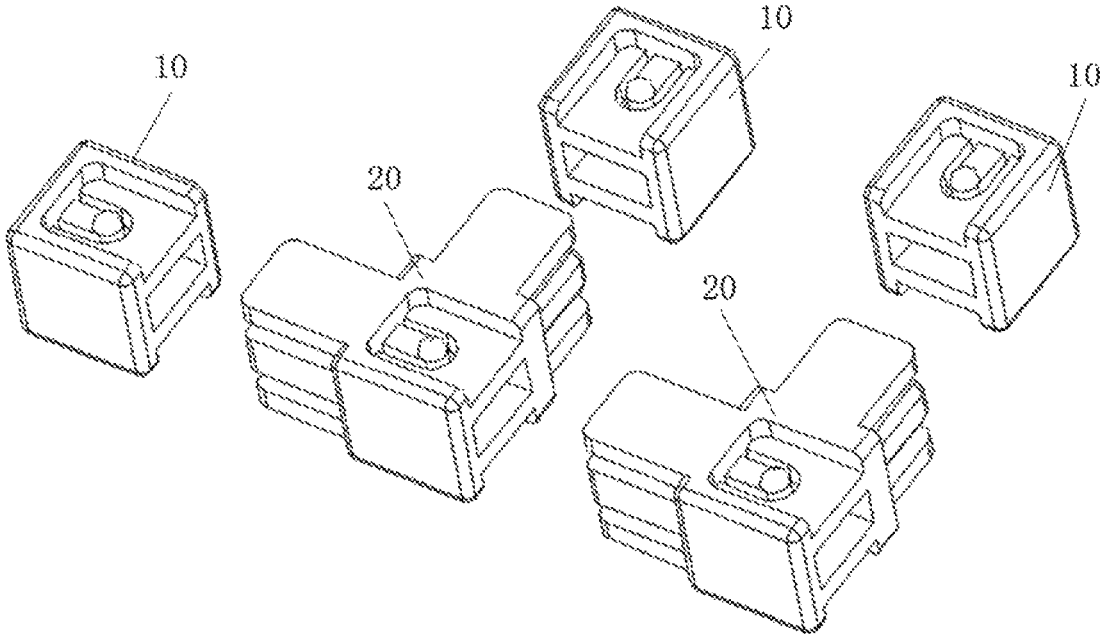
FIG. 6 is an isometric view of a building block kit including building blocks of FIG. 1.
Figure 7:
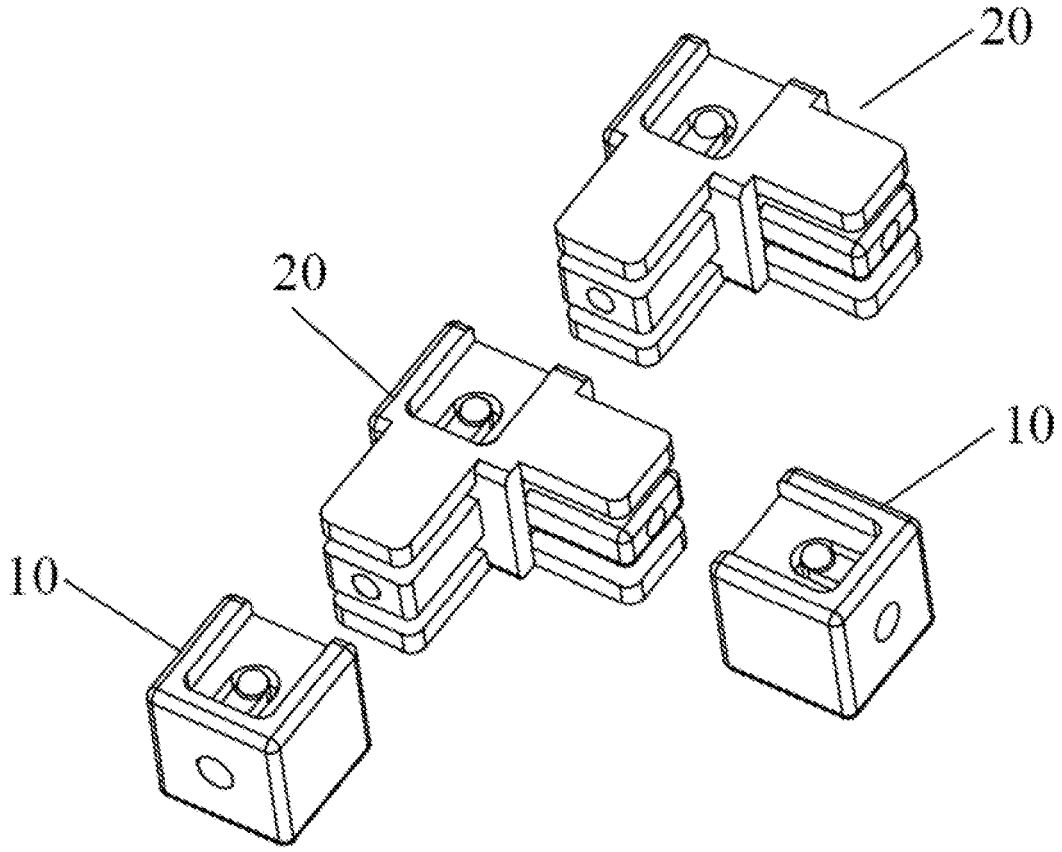
FIG. 7 is similar to FIG. 6, but differs in the number and perspective of the building blocks.

Referring to FIGS. 6 and 7, in one embodiment, a building block kit includes at least the building blocks 10 and 20. It should be noted that the numbers of the building blocks 10 and 20 can be changed according to need. With such configuration, two building blocks of the present disclosure can be firmly connected to each other, and will not be disengaged from each other without an external fore from a user. In addition, the deflection of the cantilevered tongues is used to realize the engagement between the first and second engaging portions, which has low requirements on molds, reduces production cost, and greatly improves the competitiveness. Furthermore, the size and the number of the first engaging portions 13 and the recesses of the second engaging portions 23 can vary so as to provide different level of firmness of connection between two building blocks.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A building block kit comprising:

a male building block comprising a plug portion, the plug portion comprising two cantilevered tongues that are spaced apart from and deflectable toward each other, each of the two cantilevered tongues comprising a first engaging portion at an end thereof;

a female building block comprising a socket portion defining a chamber and comprising two second engaging portions in the chamber;

wherein the plug portion and the socket portion are configured in such a way that the plug portion is insertable into the chamber, and the first engaging portions are engaged with the second engaging portions after the plug portion is inserted into the chamber, thereby connecting the male building block and the female building block together;

wherein the socket portion further comprises a block in the chamber, the block is configured to be received in a hollow space of the male building block after the plug portion is inserted into the chamber, so as to guide the male building block during insertion of the plug portion;

wherein the plug portion comprises a first main body that comprises three side walls that are connected to one another, and two inner plates arranged within a space defined by the three side walls and connected to the three side walls, the two cantilevered tongues protrude from one of the side walls that is connected to both of the other two side walls, each of the two inner plates defines a through hole, the two cantilevered tongues are respectively received in the through holes of the two inner plates.

2. The building block kit according to claim 1, wherein the socket portion comprises two outer plates that are spaced apart from each other and corporately define the chamber, the two second engaging portions are respectively arranged on the two outer plates, the three side walls and the two inner plates corporately define two receiving spaces, the two outer plates are respectively received in the two receiving spaces when the male building block and the female building block are connected to each other.

3. The building block kit according to claim 2, wherein the two inner plates corporately define the hollow space therebetween, the block is arranged between the two outer plates.

4. The building block kit according to claim 3, wherein the through holes respectively communicate with the receiving spaces.

5. The building block kit according to claim 3, wherein the hollow space has a rectangular cross section, and a cross section of the block is shaped and sized according to the cross section of the hollow space.

6. The building block kit according to claim 3, wherein the one of the side walls from which the cantilevered tongues protrude defines a first orifice extending therethrough, and the block defines a second orifice corresponding to the first orifice.

7. The building block kit according to claim 2, wherein the socket portion comprises a second main body, and the two outer plates protrude from the second main body.

8. The building block kit according to claim 7, wherein the socket portion further comprises two additional outer plates protruding from the second main body, and the two additional outer plates are shaped and sized in a same way as the two outer plates, and extend in a direction perpendicular to an extending direction of the two outer plates, or in a direction opposite the extending direction of the two outer plates.

* * * * *